US009520113B2

(12) United States Patent
Vermillion

(10) Patent No.: US 9,520,113 B2
(45) Date of Patent: Dec. 13, 2016

(54) RESONANCE CONTROL COMPRESSION PAD FOR THE ACOUSTIC BASS DRUM

(71) Applicant: Michael G. Vermillion, Marietta, GA (US)

(72) Inventor: Michael G. Vermillion, Marietta, GA (US)

(73) Assignee: Sledgepad Innovations, LLC, Marietta, GA (US)

( * ) Notice: Subject to any disclaimer, the term of this patent is extended or adjusted under 35 U.S.C. 154(b) by 17 days.

(21) Appl. No.: 14/734,476

(22) Filed: Jun. 9, 2015

(65) Prior Publication Data

US 2015/0364119 A1 Dec. 17, 2015

Related U.S. Application Data

(60) Provisional application No. 62/011,503, filed on Jun. 12, 2014.

(51) Int. Cl.
*G10D 13/02* (2006.01)

(52) U.S. Cl.
CPC ..... *G10D 13/021* (2013.01); *G10D 13/02* (2013.01); *G10D 13/022* (2013.01); *G10D 13/023* (2013.01)

(58) Field of Classification Search
CPC ..... G10D 13/02; G10D 13/021; G10D 13/022
USPC ..... 84/453, 411 M, 411 R
See application file for complete search history.

(56) References Cited

U.S. PATENT DOCUMENTS 635,192 A * 10/1899 Sapp ..... G10D 13/023 84/411 R
4,026,185 A * 5/1977 Migirian ..... G10D 13/021 84/411 R
4,300,437 A * 11/1981 Hinger ..... G10D 13/028 84/411 R
4,325,281 A * 4/1982 Hardy ..... G10D 13/022 84/411 M
4,338,850 A * 7/1982 Payson ..... G10D 13/022 84/411 M
4,519,288 A * 5/1985 Aluisi ..... G10D 13/022 84/411 M
4,567,807 A * 2/1986 Robinson ..... G10D 13/022 84/411 M (Continued)

*Primary Examiner* — David Warren
*Assistant Examiner* — Christina Schreiber
(74) *Attorney, Agent, or Firm* — Patentfile, LLC; Bradley C. Fach; Steven R. Kick

(57) ABSTRACT

A resonance control compression pad for the acoustic bass drum which in some embodiments may comprise: an elongate batter head contacting surface; an elongate resonance head contacting surface opposingly positioned to the elongate batter head contacting surface; and a plurality of baffles coupled to the elongate batter head contacting surface and to the elongate resonance head contacting surface. The elongate resonance head contacting surface may be configured to contact portions of a resonant head when the pad is positioned within a drum instrument, while the elongate batter head contacting surface may be configured to contact portions of a batter head when the pad is positioned within a drum instrument. The elongate resonance head contacting surface may exert pressure on the resonant head and the elongate batter head contacting surface may likewise exert pressure on the batter head, thereby providing resonance control to the drum instrument.

20 Claims, 6 Drawing Sheets

(56) References Cited

U.S. PATENT DOCUMENTS 4,790,228 A * 12/1988 Thirion ..... G10D 13/028 84/411 R
4,899,635 A * 2/1990 Santangelo ..... G10D 13/022 84/411 M
5,088,376 A * 2/1992 Crago ..... G10D 13/022 84/411 M
5,361,669 A * 11/1994 Genna ..... G10K 11/04 181/156
5,398,583 A * 3/1995 Cook ..... G10D 13/022 84/411 M
5,892,168 A * 4/1999 Donohoe ..... G10D 13/022 84/411 M
6,057,499 A * 5/2000 Basmadjian ..... G10D 13/00 84/411 R
6,573,441 B2 * 6/2003 Norris, Jr. ..... G10D 13/022 84/411 M
7,488,883 B2 * 2/2009 Wang ..... G10D 13/021 84/411 M
7,569,758 B2 * 8/2009 Harada ..... G10D 13/024 84/411 M
8,541,675 B2 * 9/2013 Strickland ..... G10D 13/022 84/411 M
9,190,040 B2 * 11/2015 Hashimoto ..... G10D 13/027
9,330,642 B2 * 5/2016 Nicholson ..... G10D 13/022
2008/0265233 A1 * 10/2008 Flannery ..... E06B 9/04 256/73
2010/0043622 A1 * 2/2010 Sandson ..... G10D 13/00 84/421
2010/0175535 A1 * 7/2010 Lento ..... G10D 13/021 84/414
2014/0224612 A1 * 8/2014 Boonpongmanee .. F16D 25/046 192/79
2015/0020673 A1 * 1/2015 Millender, Jr. ..... G10D 13/021 84/294
2016/0225353 A1 * 8/2016 Di Cicco ..... G10D 13/02

* cited by examiner

RESONANCE CONTROL COMPRESSION PAD FOR THE ACOUSTIC BASS DRUM

CROSS REFERENCE TO RELATED APPLICATIONS

This application claims priority to and the benefit of the filing date of U.S. Provisional Application No. 62/011,503, filed on Jun. 12, 2014, entitled "RESONANCE CONTROL COMPRESSION PAD FOR THE ACOUSTIC BASS DRUM", which is hereby incorporated by reference in its entirety.

FIELD OF THE INVENTION

This patent specification relates to the field of drums. More specifically, this patent specification relates to bass drum damping apparatuses for the purpose of altering acoustic bass drum tonal qualities.

BACKGROUND

The bass drum has been a key part of popular music for many decades. Because of the need for better quality drum sounds, artists, drummers, sound engineers, producers and others in the music business have used various tone-modifying methods to improve the sound of the bass drum for live performances and studio recordings. Conventional methods to dampen excessive overtones, harmonics, and ring in acoustic bass drums have usually been blankets and pillows, an exterior muffler or duct tape to dampen vibrations that result from the drumhead being struck by the bass drum pedal beater, and the resonances occurring within the front, or resonant head. These have been known to achieve varied results depending on the size and consistency of the material and system used to anchor the material.

Acoustic foam has been used to attenuate airborne sound waves by increasing air resistance, thus reducing the amplitude of the waves. The energy is dissipated as heat. However, current implementations of acoustic foam for acoustic treatment of bass drums have had undesirable consequences to the sound of the bass drum.

Therefore, a need exists for novel resonance control apparatuses for the acoustic bass drum. A further need exists for novel resonance control apparatuses that are able to solve the problems of acoustic overtones and ring in acoustic bass drums.

BRIEF SUMMARY OF THE INVENTION

A resonance control compression pad for the acoustic bass drum is provided which may be used with a drum instrument of the type including a resonant head and an opposing batter head which are supported in a stretched state by a rigid frame and which can be selectively vibrated when the drum is played. In some embodiments, the pad may comprise an elongate batter head contacting surface; an elongate resonance head contacting surface opposingly positioned to the elongate batter head contacting surface; and a plurality of baffles coupled to the elongate batter head contacting surface and to the elongate resonance head contacting surface. The elongate resonance head contacting surface may be configured to contact portions of a resonant head when the pad is positioned within a drum instrument, while the elongate batter head contacting surface may be configured to contact portions of a batter head when the pad is positioned within a drum instrument. Once the pad is positioned within a drum instrument, the elongate resonance head contacting surface may exert pressure on the resonant head and the elongate batter head contacting surface may likewise exert pressure on the batter head, thereby providing resonance control to the drum instrument.

In further embodiments, a resonance control compression pad may further comprise a planar baffle coupled to a plurality of baffles. The planar baffle may comprise a planar baffle elongate batter head contacting surface configured to contact the batter head of the drum in addition to the contact provided by the elongate batter head contacting surface. Once the pad is positioned within a drum instrument, the elongate resonance head contacting surface may exert pressure on the resonant head while both the planar baffle elongate batter head contacting surface and the elongate batter head contacting surface may likewise exert pressure on the batter head, thereby providing resonance control to the drum instrument.

In still further embodiments, the length of the elongate batter head contacting surface may be greater than the length of the elongate resonance head contacting surface.

In still further embodiments, the surface area of the batter head contacted by the elongate batter head contacting surface may be greater than the surface area of the resonance head contacted by the elongate resonance head contacting surface.

In even further embodiments, the surface area of the batter head contacted by the elongate batter head contacting surface and the planar baffle elongate batter head contacting surface may be greater than the surface area of the resonance head contacted by the elongate resonance head contacting surface.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
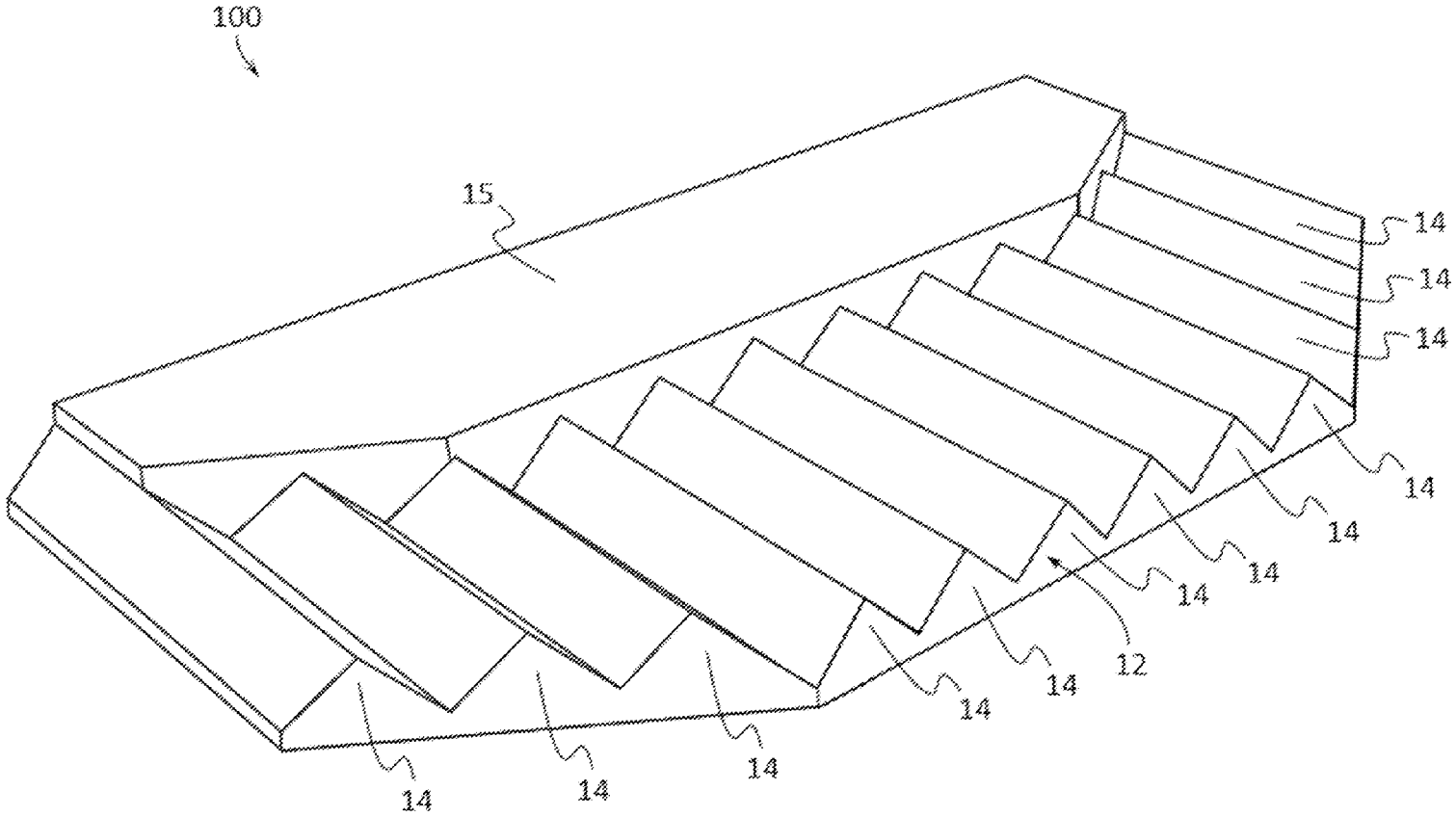
FIG. 1 depicts a front top perspective view of an example of a resonance control compression pad for the acoustic bass drum according to various embodiments described herein.

For purposes of description herein, the terms "top", "bottom", "side", "rear", "front", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

New bass drum damping apparatuses are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 2:
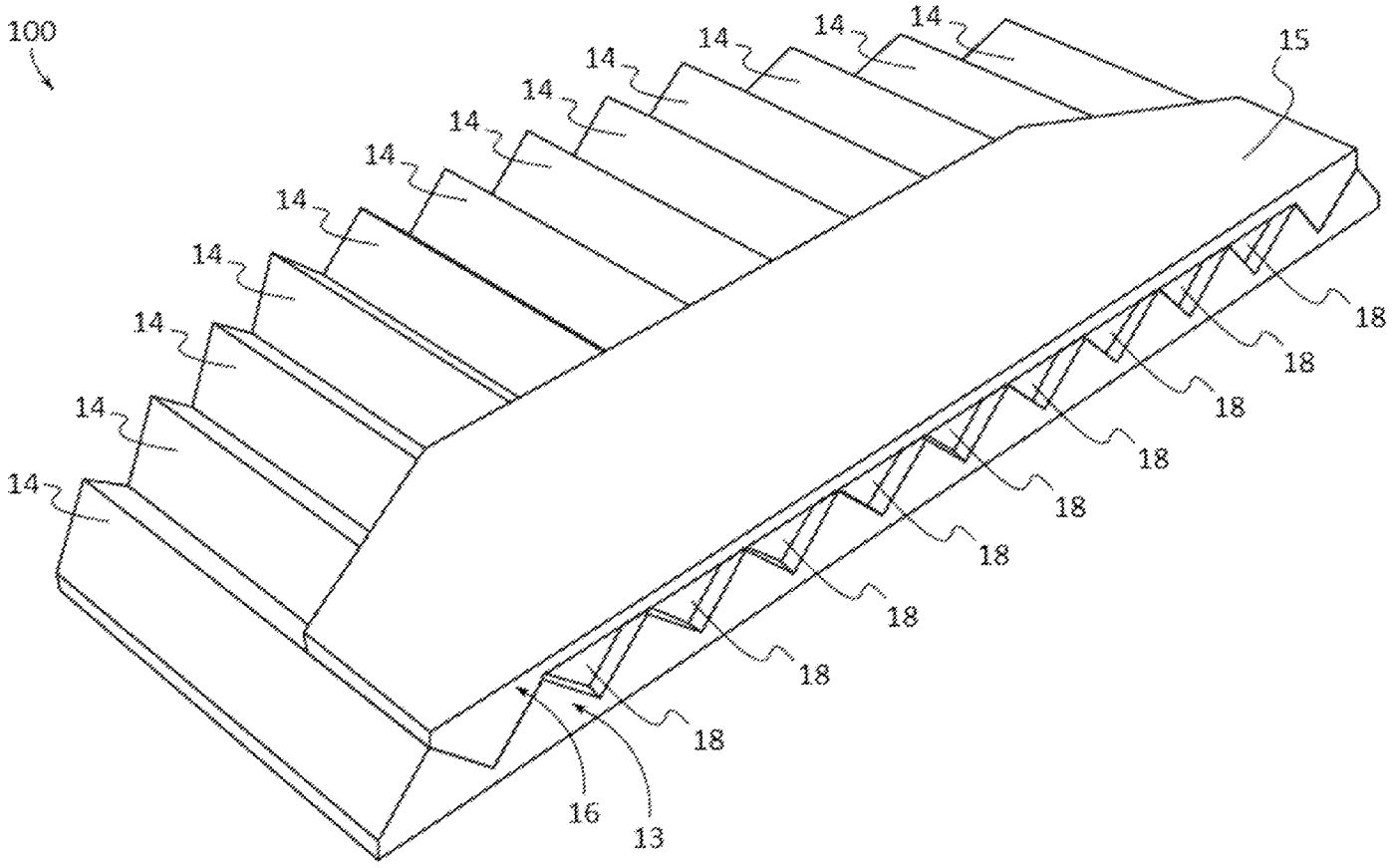
FIG. 2 illustrates a rear top perspective view of an example of a resonance control compression pad for the acoustic bass drum according to various embodiments described herein.

The present invention will now be described by example and through referencing the appended figures representing preferred and alternative embodiments. FIGS. 1 and 2 illustrate perspective views of an example of a resonance control compression pad for the acoustic bass drum ("the pad") 100 according to various embodiments which may be used with a drum instrument 200 (FIGS. 9 and 10) of the type including a resonant head 201 (FIG. 9) and an opposing batter head 202 (FIG. 10) which are supported in a stretched state by a rigid frame 203 (FIGS. 9 and 10) and which can be selectively vibrated when the drum 200 is played. In this example, the pad 100 comprises an elongate batter head contacting surface 13; an elongate resonance head contacting surface 12 opposingly positioned to the elongate batter head contacting surface 13; and a plurality of baffles 14 coupled to the elongate batter head contacting surface 13 and to the elongate resonance head contacting surface 12.

Figure 9:
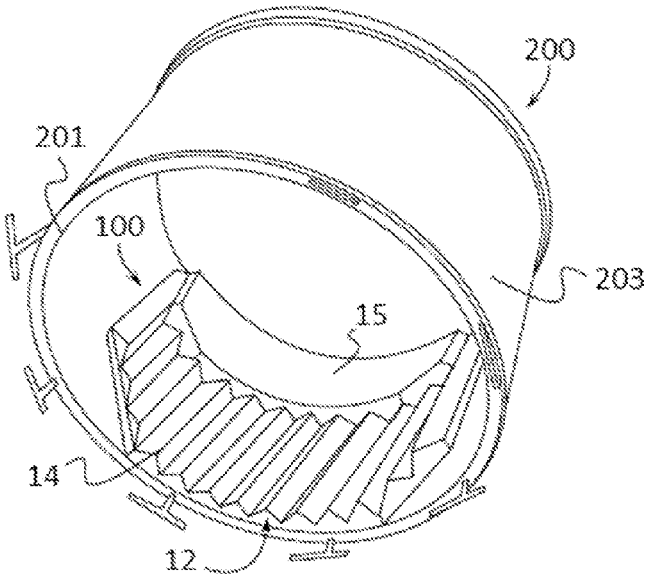
FIG. 9 shows a front perspective view of an example of a resonance control compression pad for the acoustic bass drum positioned within a drum instrument according to various embodiments described herein.
Figure 10:
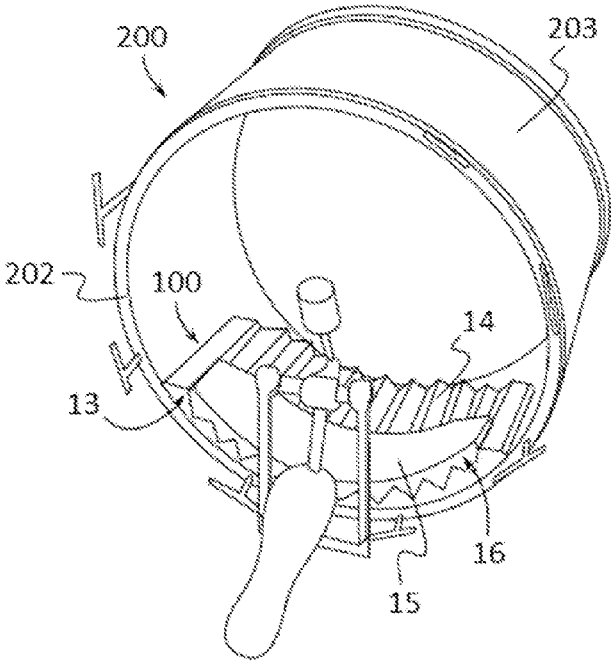
FIG. 10 depicts a rear perspective view of an example of a resonance control compression pad for the acoustic bass drum positioned within a drum instrument according to various embodiments described herein.

An elongate resonance head contacting surface 12 may be configured to contact portions of a resonant head 201 (FIG. 9) when the pad 100 is positioned within a drum instrument 200 (FIGS. 9 and 10). In some embodiments, an elongate resonance head contacting surface 12 may comprise a generally planar shape similar to the generally planar shape of a resonant head 201. An elongate batter head contacting surface 12 may be configured to contact portions of a batter head 202 (FIG. 10) when the pad 100 is positioned within a drum instrument 200 (FIGS. 9 and 10). In some embodiments, an elongate batter head contacting surface 13 may comprise a generally planar shape similar to the generally planar shape of a batter head 202.

As perhaps best shown in FIGS. 1 and 2, in some embodiments, a baffle 14 may comprise a generally elongated triangular prism shape allowing it to attenuate airborne sound waves such as by increasing air resistance. A pad 100 may comprise any number of baffles 14 such as between one and 24 baffles 14. In further embodiments, a baffle 14 may be configured in a plurality of sizes and shapes including rectangular prism shaped, cylinder shaped, hexagonal prism shaped, pyramid shaped, wedge shaped, or any other geometric or non-geometric shape, including combinations of shapes which may be formed into acoustic foam. It is not intended herein to mention all the possible alternatives, equivalent forms or ramifications of the invention. It is understood that the terms and proposed shapes of baffles 14 used herein are merely descriptive, rather than limiting, and that various changes may be made without departing from the spirit or scope of the invention.

In further embodiments, the pad 100 may also comprise a planar baffle 15 which may be positioned on a top portion of the pad 100. A planar baffle 15 may comprise a planar baffle elongate batter head contacting surface 16 which may be configured to contact the batter head of the drum 202 (FIG. 10). Generally, a planar baffle elongate batter head contacting surface 16 may be positioned in the same plane as the elongate batter head contacting surface 13, thereby allowing the planar baffle elongate batter head contacting surface 16 to contact the batter head of the drum 202 when the elongate batter head contacting surface 13 is contacting the batter head of the drum 202 when the pad 100 is positioned within a drum instrument 200 (FIGS. 9 and 10). In some embodiments, a plurality of baffles 14 may be coupled to a planar baffle 15 which may be coupled to the elongate batter head contacting surface 13, thereby coupling the plurality of baffles 14 to the elongate batter head contacting surface 13.

Figure 3:
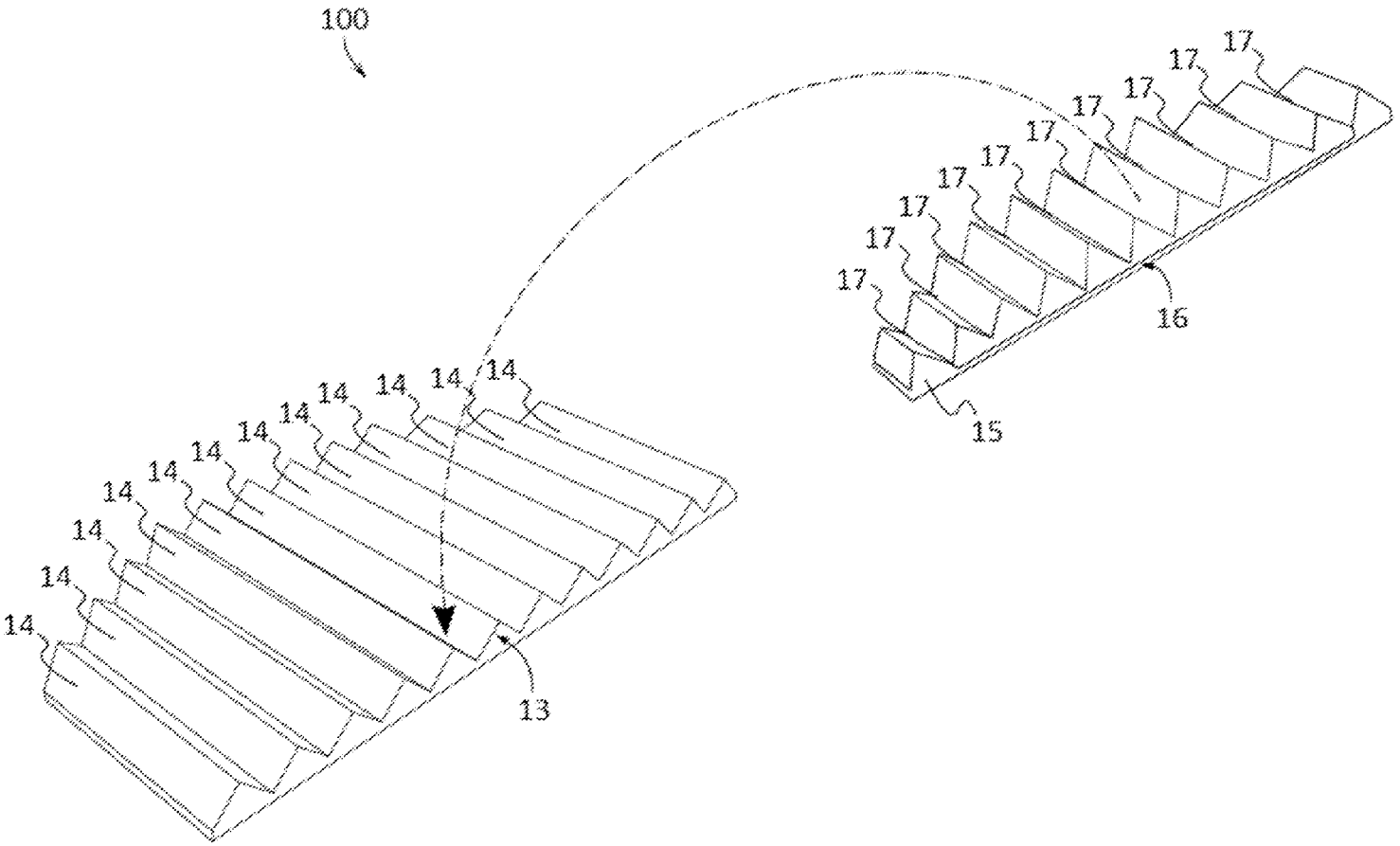
FIG. 3 shows an exploded perspective view of an example of a resonance control compression pad for the acoustic bass drum according to various embodiments described herein.

Turning now to FIG. 3, an exploded perspective view of an example of a resonance control compression pad for the acoustic bass drum according to various embodiments described herein is shown. In this example, a plurality of baffles 14 is shown coupled to the elongate batter head contacting surface 13 and to the elongate resonance head contacting surface 12. In some embodiments, the pad 100 may be formed by coupling a planar baffle 15 to a plurality of baffles 14. The planar baffle 15 may comprise a plurality of baffle receiving formations 17. A baffle receiving formation 17 may be generally complementary in shape to a baffle 14 allowing the baffle receiving formations 17 to mate with the baffles 14 when the planar baffle 15 is coupled to a plurality of baffles 14. The planar baffle 15 may be coupled to a portion of a plurality of baffles 14 proximate to the elongate batter head contacting surface 13 with the planar baffle elongate batter head contacting surface 16 positioned generally in the same plane as the elongate batter head contacting surface 13. In other embodiments, the planar baffle 15 may be integrally formed or molded to the plurality of baffles 14 and the planar baffle elongate batter head contacting surface 16 may also be integrally formed or molded into the elongate batter head contacting surface 13, thereby forming a continuous elongate batter head contacting surface 13.

Figure 7:
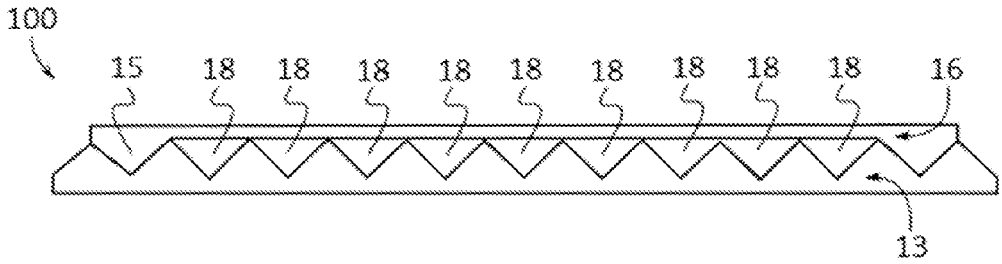
FIG. 7 depicts a rear elevation view of an example of a resonance control compression pad for the acoustic bass drum according to various embodiments described herein.

As shown in FIGS. 2 and 7, in some embodiments, a pad 100 may comprise one or more, such as a plurality of depressions 18 which may be formed along the elongate batter head contacting surface 13 and the planar baffle elongate batter head contacting surface 16. A depression 18 may be configured to decrease the amount of the pad 100 that is configured to contact the batter head 202 (FIG. 10), thereby decreasing the resilience of the elongate batter head contacting surface 13 and the planar baffle elongate batter head contacting surface 16. Optionally, a depression 18 may also allow the pad 100 to breathe so that air may circulate within one or more depressions 18 and the batter head 202. By increasing the number of depressions 18, the elongate batter head contacting surface 13 and the planar baffle elongate batter head contacting surface 16 may more easily compress and decrease amount of impact controlling acoustic amplitude the pad 100 is able to provide when placed within a drum instrument 200 (FIGS. 9 and 10). By decreasing the number of depressions 18, the elongate batter head contacting surface 13 and the planar baffle elongate batter head contacting surface 16 may resist compression and increase amount of impact controlling acoustic amplitude the pad 100 is able to provide when placed within a drum instrument 200 (FIGS. 9 and 10).

In some embodiments, one or more depressions 18 may comprise a triangular prism shape. In other embodiments, a depression 18 may be configured in a plurality of sizes and shapes including square prism shaped, rectangular prism shaped, cylinder shaped, hexagonal prism shaped, or any other geometric or non-geometric shape, including combinations of shapes that may define a volume to decrease the amount of the pad 100 that is configured to contact the batter head 202 (FIG. 10). It should be understood to one of ordinary skill in the art that the terms and proposed shapes used herein regarding a depression 18 are exemplary, rather than limiting, and that various changes may be made without departing from the spirit or scope of the invention.

Figure 4:
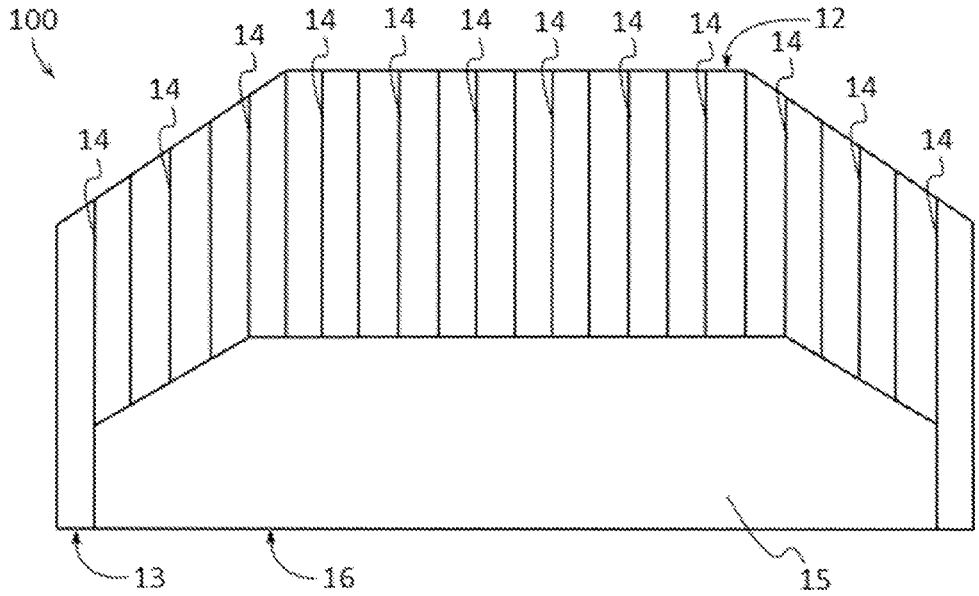
FIG. 4 depicts a top plan view of an example of a resonance control compression pad for the acoustic bass drum according to various embodiments described herein.
Figure 5:
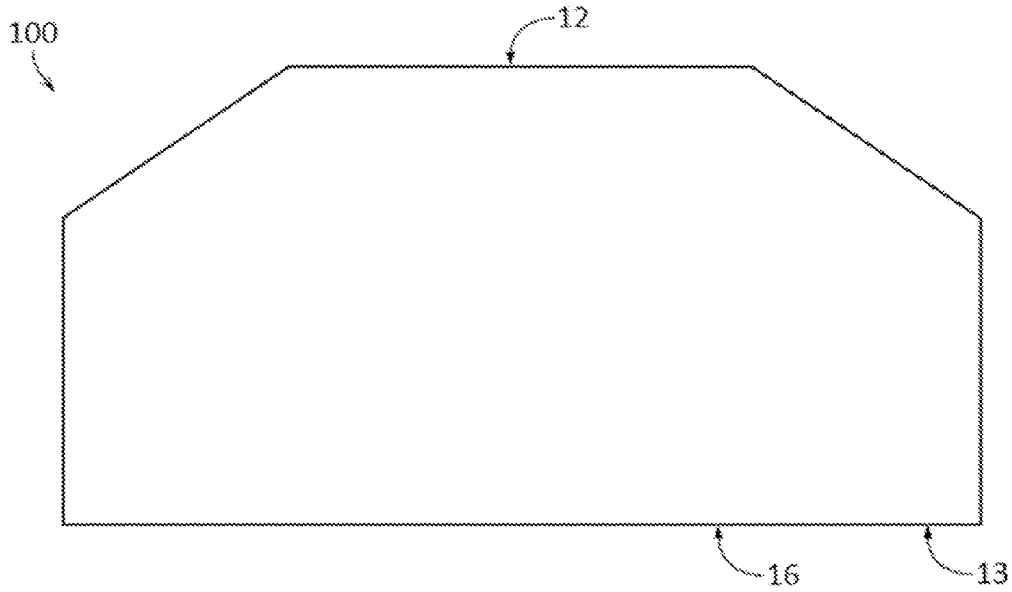
FIG. 5 illustrates a bottom plan view of an example of a resonance control compression pad for the acoustic bass drum according to various embodiments described herein.
Figure 6:
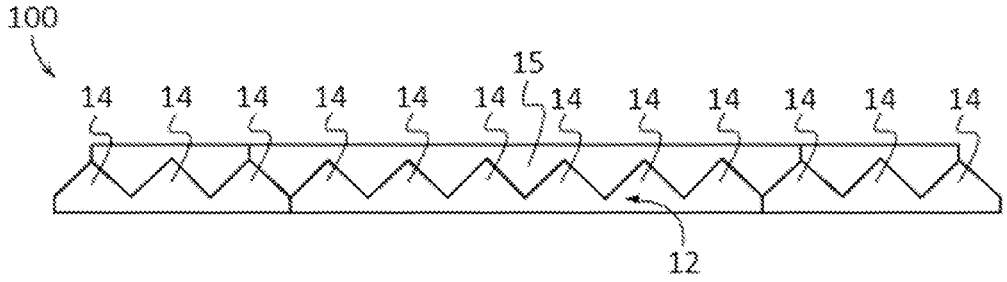
FIG. 6 shows a front elevation view of an example of a resonance control compression pad for the acoustic bass drum according to various embodiments described herein.
Figure 8:
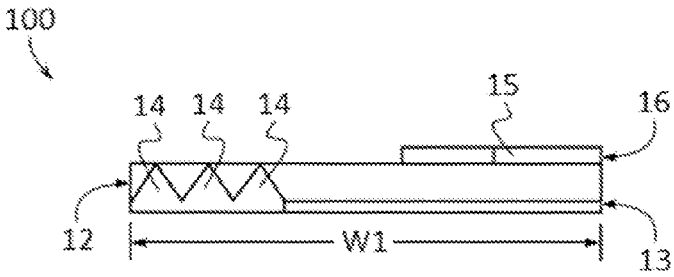
FIG. 8 illustrates a side elevation view of an example of a resonance control compression pad for the acoustic bass drum according to various embodiments described herein.

Referring now to FIGS. 4, 5, and 8, the pad 100 may comprise an elongate resonance head contacting surface 12 opposingly positioned to the elongate batter head contacting surface 13. In some embodiments, the elongate batter head contacting surface 13 may be generally parallel to the elongate resonance head contacting surface 12. When the pad 100 is placed within a drum instrument 200 (FIGS. 9 and 10), the elongate resonance head contacting surface 12 and the elongate batter head contacting surface 13 may contact the resonant head 201 (FIG. 9) and the batter head 202 (FIG. 10), respectively, since the resonant head 201 and batter head 202 are generally parallel and opposingly positioned to each other. In further embodiments, the planar baffle elongate batter head contacting surface 16 of the planar baffle 15 may be positioned generally within the same plane as the elongate batter head contacting surface 13 so that the planar baffle elongate batter head contacting surface 16 is also parallel and opposingly positioned to the resonance head contacting surface 12. When the pad 100 is placed within a drum instrument 200, both the elongate batter head contacting surface 13 and the planar baffle elongate batter head contacting surface 16 may contact the batter head 202.

The pad 100 may comprise dimensions that may be scaled up or scaled down to accommodate larger or smaller, respectively, dimensioned drum instruments 200 (FIGS. 9 and 10). In some embodiments and as shown in FIGS. 4-7, the length of the elongate batter head contacting surface 13 may be greater than the length of the elongate resonance head contacting surface 12 allowing the elongate batter head contacting surface 13 to be configured to contact a greater length of the batter head 202 (FIG. 10) than the length of the resonant head 201 (FIG. 9) that the elongate resonance head contacting surface 12 may be configured to contact. In some embodiments, a planar baffle elongate batter head contacting surface 16 may also comprise a length that may be greater than, less than, or equal to the length of the elongate resonance head contacting surface 12 and/or to the length of the elongate batter head contacting surface 13. In still further embodiments, the length of the elongate resonance head contacting surface 12 may be between 25% and 75% of the length of the elongate batter head contacting surface 13. In still further embodiments, the length of the elongate resonance head contacting surface 12 may be between 40% and 60% of the length of the elongate batter head contacting surface 13. In even further embodiments, the length of the elongate resonance head contacting surface 12 may be approximately 50% of the length of the elongate batter head contacting surface 13.

In some embodiments and as shown in FIGS. 4-7, the surface area of the elongate batter head contacting surface 13 may be greater than the surface area of the elongate resonance head contacting surface 12 allowing the elongate batter head contacting surface 13 to be configured to contact a greater area of the batter head 202 (FIG. 10) than the area of the resonant head 201 (FIG. 9) that the elongate resonance head contacting surface 12 may be configured to contact. In further embodiments, the elongate batter head contacting surface 13 may have a surface area of at least 15 square inches. In further embodiments, the elongate batter head contacting surface 13 may have a surface area of between 19 and 29 square inches. In some embodiments, the elongate resonance head contacting surface 13 may have a surface area of at least 5 square inches. In further embodiments, the elongate resonance head contacting surface may have a surface area of between 7 and 17 square inches.

Generally, a pad 100 may be used with a drum instrument 200 (FIGS. 9 and 10) by placing the pad 100 within the drum 200 with the elongate resonance head contacting surface 12 contacting the resonant head 201 (FIG. 9) and with the elongate batter head contacting surface 13 and preferably the planar baffle elongate batter head contacting surface 16 contacting the batter head 202 (FIG. 10). In some embodiments, the pad 100 may comprise a width W1 defined as the distance the elongate batter head contacting surface 13 and preferably the planar baffle elongate batter head contacting surface 16 is separated from the elongate resonance head contacting surface 12 as shown in FIG. 8. In further embodiments, W1 may be greater than the distance separating the resonant head 201 from the opposing batter head 202 of the drum 200. The pad 100 may also be made from a compressible and resilient material such as acoustic foam which may compress and cause the elongate resonance head contacting surface 12 to press against the resonant head 201 (FIG. 9) and the elongate batter head contacting surface 13 and preferably the planar baffle elongate batter head contacting surface 16 to likewise press against the batter head 202 when the pad 100 is placed within the drum 200. In further embodiments, W1 may be between 0.1 inches and 3.0 inches greater than the distance separating the resonant head 201 from the opposing batter head 202 of the drum 200. In still further embodiments, W1 may be between 0.25 inches and 0.5 inches greater than the distance separating the resonant head 201 from the opposing batter head 202 of the drum 200.

As W1 is increased relative to the distance separating the resonant head 201 from the opposing batter head 202 of the drum 200, the elongate resonance head contacting surface 12 may exert greater pressure on the resonant head 201 and with the elongate batter head contacting surface 13 and preferably the planar baffle elongate batter head contacting surface 16 may likewise exert greater pressure on the batter head 202. Conversely, as W1 is decreased relative to the distance separating the resonant head 201 from the opposing batter head 202 of the drum 200, the elongate resonance head contacting surface 12 may exert lesser pressure on the resonant head 201 and with the elongate batter head contacting surface 13 and preferably the planar baffle elongate batter head contacting surface 16 may likewise exert lesser pressure on the batter head 202.

FIG. 9 shows a front perspective view of an example of a resonance control compression pad 100 for the acoustic bass drum positioned within a drum instrument 200 according to various embodiments described herein. The pad 100 may be used with a drum instrument 200 of the type including a resonant head 201 and an opposing batter head 202 (FIG. 10) which are supported in a stretched state by a rigid frame 203 and which can be selectively vibrated when the drum 200 is played. As perhaps best shown by FIG. 9, the pad 100 may be positioned within the drum 200 so that the elongate resonance head contacting surface 12 may contact and preferably exert pressure on the resonant head 201 (FIG. 9).

FIG. 10 shows a rear perspective view of an example of a resonance control compression pad 100 for the acoustic bass drum positioned within a drum instrument 200 according to various embodiments described herein. The pad 100 may be used with a drum instrument 200 of the type including a resonant head 201 and an opposing batter head 202 (FIG. 10) which are supported in a stretched state by a rigid frame 203 and which can be selectively vibrated when the drum 200 is played. As perhaps best shown by FIG. 10, the pad 100 may be positioned within the drum 200 so that the elongate batter head contacting surface 13 and preferably the planar baffle elongate batter head contacting surface 16 may exert pressure on the batter head 202 and the elongate resonance head contacting surface 12 may contact and preferably exert pressure on the resonant head 201 as shown in FIG. 9.

In some embodiments, a pad 100 may be made from a compressible and resilient material such as acoustically dampening foam sometimes called acoustic foam. By securing the pad 100 to the resonant head 201 and to the opposing batter head 202 of the drum 200 without contacting the rigid frame 203 of the drum 200, air and sound waves may circulate around the entirety of the frame 203 within the drum 200. The compressible and resilient nature of the material may allow the pad 100 to be formed in the planar configuration as shown in FIGS. 1-8, and then bent into the curved configuration as shown in FIGS. 9 and 10. In further embodiments, the pad 100 may be secured to the resonant head 201 and to the opposing batter head 202 of the drum 200 without contacting the rigid frame 203 of the drum 200. The pad 100 may be bent into a curved configuration as shown in FIGS. 9 and 10 and then compressed between the resonant head 201 and the opposing batter head 202 thereby maintaining the curved configuration and preventing the pad 100 from contacting the rigid frame 203 of the drum 200 by the frictional engagement or securement between the pad 100 and the heads, 201, 202, of the drum 200. In other embodiments, the pad 100 may be formed in a curved configuration as shown in FIGS. 9 and 10 and then compressed between the resonant head 201 and the opposing batter head 202 thereby preventing the pad 100 from contacting the rigid frame 203 of the drum 200 by the frictional engagement or securement between the pad 100 and the heads, 201, 202, of the drum 200.

In alternative embodiments, the elongate resonance head contacting surface 12 may be secured to the resonant head 201 with an adhesive such as with a double sided adhesive tape or foam tab. In further alternative embodiments, the elongate batter head contacting surface 13 and preferably the planar baffle elongate batter head contacting surface 16 may be secured to the batter head 202 with an adhesive such as with a double sided adhesive tape or foam tab. In still further embodiments, the elongate resonance head contacting surface 12 may be secured to the resonant head 201 and the elongate batter head contacting surface 13 and preferably the planar baffle elongate batter head contacting surface 16 may be secured to the batter head 202 with an adhesive such as with a double sided adhesive tape or foam tab without contacting the rigid frame of the drum.

In some embodiments, a pad 100 may be made from or comprise an acoustically dampening foam commonly referred to as acoustic foam. In further embodiments, the pad 100 may be made from or comprise an open cell acoustically dampening foam such as polyurethane foam. In still further embodiments, the pad 100 may be made from or comprise any acoustic foam material which may be used to attenuate airborne sound waves such as by increasing air resistance, thus reducing the amplitude of the waves including reticulated or un-reticulated polymers, ceramics, metals, or any other suitable material.

In some embodiments, the pad 100 may comprise one or more rigid durable materials such as aluminum, steel, other metals and metal alloys, wood, hard rubbers, hard plastics, fiber reinforced plastics, carbon fiber, fiber glass, resins, polymers or any other suitable materials including combinations of materials which may be encased or surrounded by an acoustically dampening foam onto which the components of the pad 100 may be formed or molded. Additionally, one or more elements may be made from or comprise durable and slightly flexible materials such as soft plastics, silicone, soft rubbers, or any other suitable materials including combinations of materials which may be encased or surrounded by an acoustically dampening foam onto which the components of the pad 100 may be formed or molded. In some embodiments, one or more of the elements that comprise the pad 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the pad 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function. In further embodiments, one or more of the elements that comprise the pad 100 may be coupled by being one of connected to and integrally formed with another element of the pad 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A resonance control compression pad for use with a drum instrument of the type including a resonant head separated by a first distance from an opposing batter head, both the resonant head and the batter head supported in a stretched state by a rigid frame and which can be selectively vibrated when the drum is played, the pad comprising:

a. an elongate batter head contacting surface;

b. an elongate resonance head contacting surface opposingly positioned to the elongate batter head contacting surface;

c. a plurality of baffles positioned between the elongate batter head contacting surface and the elongate resonance head contacting surface; and wherein the resonance control compression pad has a first width (W1) defined as the distance between the elongate batter head contacting surface and the elongate resonance head contacting surface, and wherein the first width (W1) is greater than the first distance separating the resonant head from the opposing batter head.

2. The resonance control compression pad of claim 1, further comprising a planar baffle, the planar baffle comprising a planar baffle elongate batter head contacting surface configured to contact the batter head of the drum.

3. The resonance control compression pad of claim 2, further comprising a plurality of depressions formed along the elongate batter head contacting surface and the planar baffle elongate batter head contacting surface.

4. The resonance control compression pad of claim 3, wherein the depressions comprise a triangular prism shape.

5. The resonance control compression pad of claim 1, wherein the length of the elongate batter head contacting surface is greater than the length of the elongate resonance head contacting surface.

6. The resonance control compression pad of claim 5, wherein the length of the elongate resonance head contacting surface is between 25% and 75% of the length of the elongate batter head contacting surface.

7. The resonance control compression pad of claim 5, wherein the length of the elongate resonance head contacting surface is between 40% and 60% of the length of the elongate batter head contacting surface thereby forming a tapered shape to the resonance control compression pad.

8. The resonance control compression pad of claim 5, wherein the elongate batter head contacting surface has a surface area of at least 15 square inches.

9. The resonance control compression pad of claim 5, wherein the elongate batter head contacting surface has a surface area of between 19 and 29 square inches.

10. The resonance control compression pad of claim 5, wherein the elongate resonance head contacting surface has a surface area of at least 5 square inches.

11. The resonance control compression pad of claim 5, wherein the elongate resonance head contacting surface has a surface area of between 7 and 17 square inches.

12. The resonance control compression pad of claim 1, wherein the pad is made from an acoustically dampening foam.

13. The resonance control compression pad of claim 12, wherein the pad is made from an open cell acoustically dampening foam.

14. The resonance control compression pad of claim 1, wherein a baffle of the plurality of baffles comprises an elongated triangular prism shape.

15. The resonance control compression pad of claim 1, wherein the plurality of baffles are triangular prism shaped baffles extending along the first width (W1) of the pad.

16. The resonance control compression pad of claim 1, further comprising a planar baffle coupled to the plurality of baffles.

17. The resonance control compression pad of claim 1, wherein the elongate batter head contacting surface is parallel to the elongate resonance head contacting surface.

18. The resonance control compression pad of claim 1, wherein the pad is secured to the resonant head and to the opposing batter head of the drum without contacting the rigid frame of the drum.

19. A resonance control compression pad for use with a drum instrument of the type including a resonant head and an opposing batter head both of which are supported in a stretched state by a rigid drum frame, the pad comprising:

a. an elongate batter head contacting surface, the elongate batter head contacting surface in direct surface contact with the batter head and configured to dampen vibrations of the batter head;

b. an elongate resonance head contacting surface opposingly positioned to the elongate batter head contacting surface, the elongate resonance head contacting surface in direct surface contact with the resonance head and configured to dampen vibrations of the resonance head; and c. a traverse baffle extending from the elongate batter head contacting surface to the elongate resonance head contacting surface.

20. The pad of claim 19, further comprising a planar baffle in direct contact with the resonance control compression pad, said planar baffle having an elongate batter head contacting surface in direct surface contact with the batter head.

* * * * *